US010632644B2

(12) United States Patent
Lee

(10) Patent No.: US 10,632,644 B2
(45) Date of Patent: Apr. 28, 2020

(54) STAPLER DEVICE

(71) Applicant: KRDC LTD., Seoul (KR)

(72) Inventor: Yong Woo Lee, Seoul (KR)

(73) Assignee: KRDC LTD. (KR)

( * ) Notice: Subject to any disclaimer, the term of this patent is extended or adjusted under 35 U.S.C. 154(b) by 167 days.

(21) Appl. No.: 15/942,267

(22) Filed: Mar. 30, 2018

(65) Prior Publication Data

US 2018/0281226 A1 Oct. 4, 2018

(30) Foreign Application Priority Data

Mar. 30, 2017 (KR) ..... 10-2017-0040709

(51) Int. Cl.

| | |
|---|---|
| ***B27F 7/36*** | (2006.01) |
| ***B65H 37/04*** | (2006.01) |
| ***B27F 7/00*** | (2006.01) |
| ***B42C 1/12*** | (2006.01) |
| ***B42B 4/00*** | (2006.01) |
| ***B27F 7/17*** | (2006.01) |

(52) U.S. Cl.

CPC ..... *B27F 7/36* (2013.01); *B27F 7/006* (2013.01); *B27F 7/17* (2013.01); *B42B 4/00* (2013.01); *B42C 1/12* (2013.01); *B65H 37/04* (2013.01); *B65H 2408/1222* (2013.01); *B65H 2801/27* (2013.01)

(58) Field of Classification Search

CPC ... B27F 7/006; B27F 7/17; B27F 7/36; B65H 37/04; B65H 2408/122; B65H 2408/1222; B42C 1/12; G03G 15/6541; G03G 2215/00827; G03G 2215/00864

USPC ..... 227/156; 270/37, 58.08, 58.09

See application file for complete search history.

(56) References Cited

U.S. PATENT DOCUMENTS

| | | | | |
|---|---|---|---|---|
| 5,330,086 | A * | 7/1994 | Shimomura | B25C 5/0228 227/153 |
| 6,164,511 | A * | 12/2000 | Chung | B27F 7/006 227/111 |
| 6,427,997 | B1 * | 8/2002 | Hirota | B42C 1/12 270/58.12 |
| 8,474,808 | B2 * | 7/2013 | Matsuo | B65H 37/04 270/58.08 |
| 8,613,382 | B2 * | 12/2013 | Jung | B27F 7/21 227/156 |
| 2011/0031677 | A1 * | 2/2011 | Ozawa | B65H 29/34 270/58.12 |
| 2012/0038100 | A1 * | 2/2012 | Jung | B65H 29/125 271/182 |
| 2015/0037120 | A1 * | 2/2015 | Kubo | B42C 1/12 412/33 |

* cited by examiner

*Primary Examiner* — Hemant Desai
*Assistant Examiner* — Jacob A Smith
(74) *Attorney, Agent, or Firm* — Renaissance IP Law Group LLP

(57) ABSTRACT

Provided is a stapler device installed to staple a bundle of papers processed and discharged from an image forming apparatus or a post-processing apparatus. The stapler device includes a stapler, and a moving unit installed to allow the stapler to reciprocate in a direction intersecting with a discharge direction of the bundle of papers. The moving unit may rotate the stapler outwardly such that a bundle of papers inserted from the outside in addition to the discharged bundle of papers is stapled in at least one end position of a range of the reciprocating movement.

8 Claims, 7 Drawing Sheets

STAPLER DEVICE

CROSS-REFERENCE TO RELATED APPLICATION

This application claims priority to and the benefit of Korean Patent Application No. 2017-0040709, filed on Mar. 30, 2017, the disclosure of which is incorporated herein by reference in its entirety.

BACKGROUND

1. Technical Field

The present disclosure relates to a stapler device, and more particularly, to a stapler device stapling a bundle of papers discharged from an image forming apparatus such as a copier, a printer, a facsimile, and the like.

2. Discussion of Related Art

Image forming apparatuses, such as copiers, printers, or facsimiles, often include an additional post-processing apparatus called a "finisher". The post-processing apparatus performs a binding process including folding, aligning, and stapling of papers which are processed in and discharged from the image forming apparatus.

Generally, staplers applied to image forming apparatuses or post-processing apparatuses are adapted to automatically move to a stapling operation position and staple a bundle of papers discharged from an image forming apparatus or a post-processing apparatus.

There are some types of stapling operations generally used in the image forming apparatuses or the post-processing apparatuses. The types of stapling operation may include a horizontal stapling and a diagonal stapling. The horizontal stapling is to perform stapling operation in a direction parallel to an upper side of papers and the diagonal stapling is to perform stapling operations in a direction diagonal to the upper side of the papers at one of both upper corners of the paper. Since the staplers applied to the image forming apparatuses or the post-processing apparatuses move to stapling positions and perform stapling operations according to user settings, the staplers have to perform linear movements for the horizontal stapling and rotational movements for the diagonal stapling.

In addition to the stapling of the bundles of papers discharged from the image forming apparatuses and the post-processing apparatuses, there is a need to perform stapling operations on bundles of papers which are inserted from the outside.

SUMMARY

The present disclosure has been made in view of the above-mentioned problems and provides a stapler device capable of stapling bundles of papers discharged from an image forming apparatus or post-processing apparatus as well as bundles of papers inserted from the outside.

In addition, the present disclosure provides a stapler device capable of diagonally stapling bundles of papers inserted from the outside.

According to an aspect of the present disclosure, there is provided a stapler device installed to staple a bundle of papers processed and discharged from an image forming apparatus or a post-processing apparatus, the stapler device including: a stapler; and a moving unit installed to allow the stapler to reciprocate in a direction intersecting with a discharge direction of the bundle of paper, wherein the moving unit rotates the stapler outwardly such that a bundle of papers inserted from the outside in addition to the discharged bundle of papers is stapled in at least one end position of a range of the reciprocating movement.

The moving unit may be installed to allow the stapler to perform the reciprocating movement which is a linear movement in the direction intersecting with the discharge direction of the bundle of paper, and may rotate the stapler at a set position on the linear movement, and the stapler may staple the discharged bundle of papers such that a staple is disposed in directions parallel and diagonal to an upper side of the discharged bundle of paper, and may staple the bundle of papers inserted from the outside in a direction diagonal to an upper side of the bundle of papers inserted from the outside.

The moving unit may include: a guide rod disposed in a direction of the reciprocating movement; a base frame provided with a guide slot portion having a slot that has a plurality of branch structures including a main branch disposed in a direction parallel to the guide rod and branches branched from the main branch; a mobile bracket installed to move on the guide rod when an external force is applied thereto, and having a rotation guide hole vertically passing therethrough; and a rotational bracket disposed on the mobile bracket in a state of being mounted with the stapler, including a first lever and a second lever inserted into the slot of the guide slot portion through the rotation guide hole and disposed to be movable along the slot, and moved together with the mobile bracket when the mobile bracket is linearly moved, wherein, when at least one of the first lever and the second lever is moved to the branch of the slot, the rotational bracket is rotated.

When the first lever is moved to the branch of the slot, the rotational bracket may be rotated toward the range of the reciprocating movement.

When the second lever is moved to the branch of the slot, the rotational bracket may be rotated outwardly from a discharge region of the bundle of papers.

The slot of the guide slot portion may have a first branch and a second branch sequentially disposed along the main branch on at least one end portion thereof, the first lever may be moved to the first branch, and the second lever may be moved to the second branch disposed at an end of the one end portion of the slot.

A first roller may be provided on a lower surface of the rotational bracket, and a cam portion may be provided in the base frame, wherein, while the rotational bracket is precedently moved, from when the first lever reaches a first branch point at which the first branch is branched, the cam portion comes into contact with the first roller to move the first roller away from the main branch of the slot, such that the first lever is moved to the first branch and the stapler is rotated toward the range of the reciprocating movement.

The cam portion may include a cam shaft, a cam element rotatably installed on the cam shaft, and an elastic operating portion including a spring operated to allow the cam element to rise in a direction intersecting with the main branch of the slot, wherein the cam portion has a convex surface which is a surface in contact with the first roller.

A second roller may be provided in the base frame, wherein, in a state in which the first lever passes through a second branch point and is continuously moved along the main branch, from when the second lever reaches the second branch point at which the second branch is branched, the second roller comes into contact with one side of the rotational bracket to rotate the rotational bracket, such that the second lever is moved to the second branch and the stapler is rotated outwardly from the discharge region of the bundle of papers.

After the mobile bracket is precedently moved in a reverse direction, that is, toward the other end portion of the slot and the first lever deviates from the first branch, in a state in which the mobile bracket is precedently moved to the one end portion of the slot and the first lever passes through the first branch point and the second branch point and is moved along the main branch, the second lever may be moved to the second branch.

The stapler device may further include a case covering the stapler and having a paper insertion slit opened in an edge thereof, through which a bundle of papers is inserted from the outside, wherein, when the stapler is rotated outwardly from the discharge region of the bundle of paper, the stapler is disposed to staple the bundle of papers inserted through the paper insertion slit.

BRIEF DESCRIPTION OF THE DRAWINGS

The above and other objects, features and advantages of the present disclosure will become more apparent to those of ordinary skill in the art by describing exemplary embodiments thereof in detail with reference to the accompanying drawings, in which.

DETAILED DESCRIPTION OF EXEMPLARY EMBODIMENTS

Hereinafter, exemplary embodiments of the present disclosure will be described in detail with reference to the accompanying drawings. In the following description of the present disclosure, detailed descriptions of known functions and components incorporated herein will be omitted in the case that the subject matter of the present disclosure is rendered unclear.

The present disclosure provides a stapler device which may be installed in an image forming apparatus, such as a copier, a scanner, or a printer, or a post-processing apparatus (so-called a "finisher") thereof. The stapler can staple bundles of papers processed in and discharged from the image forming apparatus or the post-processing apparatus. The processing may include forming images in the image or aligning, folding, and the like in the post-processing apparatus. The stapler device according to the present disclosure may automatically move a stapler in a direction intersecting a discharge direction of the processed and discharged papers and staples bundles of papers at set positions, and may also staple bundles of papers inserted from the outside in a state in which the stapler is moved to an one end side. In order to bind (or staple) the bundles of papers inserted from the outside, the stapler may be turned outwardly to staple the bundles of papers such that staples are disposed in a diagonal direction.

Figure 1:
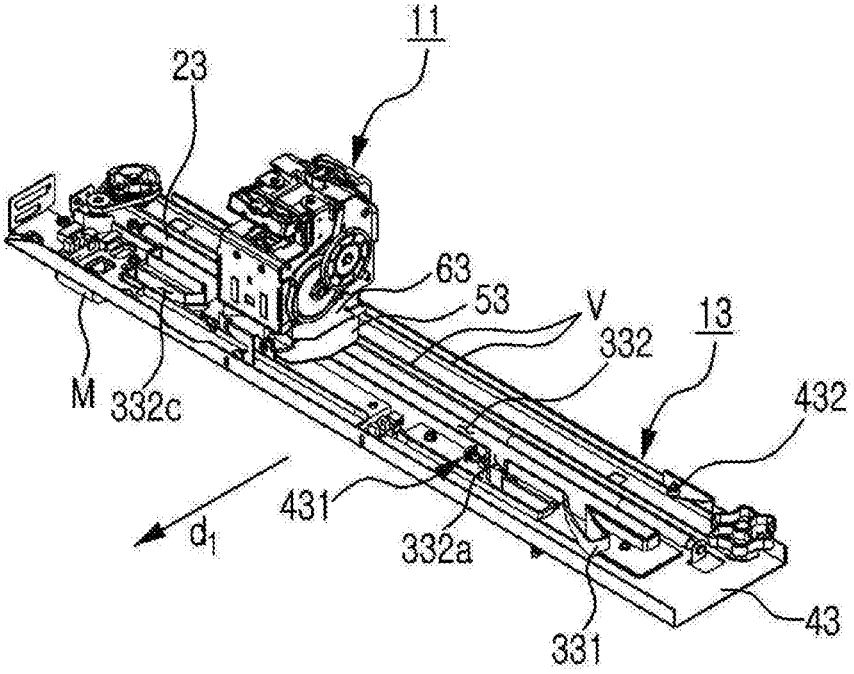
FIG. 1 is a perspective view illustrating a stapler device according to an exemplary embodiment of the present disclosure.
Figure 2:
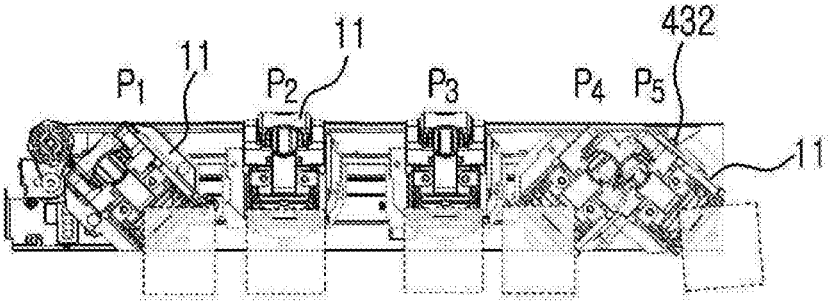
FIG. 2 is a view illustrating a type of a stapling operation of the stapler device according to the present disclosure.
Figure 3:
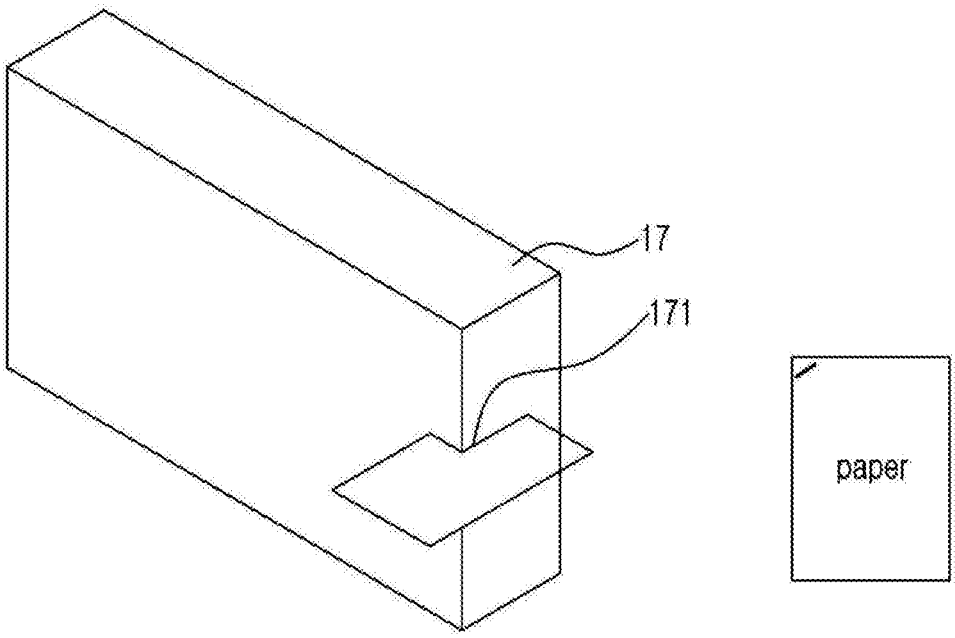
FIG. 3 is a schematic view illustrating an appearance of a post-processing apparatus including the stapler device according to the present disclosure and illustrates a manual stapling operation.

FIG. 1 is a perspective view illustrating main elements of a stapler device according to an exemplary embodiment of present disclosure. FIG. 2 is a plan view with respect to FIG. 1 and illustrates a plurality of staplers for convenience of understanding. FIG. 3 is a schematic view illustrating an appearance of an image forming apparatus or a post-processing apparatus including the stapler device according to the present disclosure.

Referring to drawings, the stapler device according to the exemplary embodiment of present disclosure includes a stapler 11 and a moving unit 13 moving the stapler 11.

When external power is applied to the stapler 11, the stapler 11 may automatically perform a stapling operation on a bundle of papers according to a set value or may perform the stapling operation according to a manually input signal. The stapler device according to the present disclosure is a device which is installed in the image forming apparatus or the post-processing apparatus and staples a bundle of papers processed in and discharged from a corresponding apparatus. The bundle of papers is discharged in a direction (paper discharge direction) dl in drawings. Although not shown, the discharged bundle of papers may be aligned and loaded onto a loading element such as a tray.

The moving unit 13 allows the stapler 11 to reciprocate in a direction intersecting with the paper discharge direction dl.

FIG. 2 is a view illustrating operation of the stapler device according to the present disclosure and illustrates the stapler 11 at each of movement positions for convenience of understanding, and an actual bundle of papers is illustrated reduced in scale.

The moving unit 13 allows the stapler 11 to be linearly or rotationally moved to each of stapling operation positions (or stapling positions) p1 to p5, and the stapler 11 performs a stapling operation on a bundle of papers at each of the stapling operation positions p1 to p5.

For example, as shown in FIG. 2, in order to staple the bundle of papers such that a staple is disposed in a direction parallel to an upper side of the bundle of paper, the moving unit 13 allows the stapler 11 to reciprocate between the stapling operation position p2 and the stapling operation position p3. Hereinafter, a case in which a stapling operation is performed such that the staple is disposed in a direction parallel to the upper side of the bundle of papers may be expressed as a case in which the stapling operation is performed in a "horizontal direction" or a "horizontal type".

In addition, in order to staple the bundle of papers at any one of both upper corners of the bundle of papers processed and discharged from the image forming apparatus or the post-processing apparatus, the moving unit 13 moves the stapler 11 to the stapling operation position p1 or p4, rotates the stapler 11 by a certain angle at a corresponding stapling operation position, and performs a stapling operation such that the staple is disposed in a direction diagonal to the upper side of the bundle of papers. In this case, as shown, the stapler 11 is rotated toward the bundle of papers or toward a range of the reciprocating movement of the stapler 11. As described above, the stapler 11 may be automatically moved and thus the stapling operation may be performed by a set value set in a controller (not shown). Hereinafter, a case in which a stapling operation is performed such that the staple is disposed in a direction diagonal to an upper side of a bundle of papers may be expressed as a case in which the stapling operation is performed in a "diagonal direction" or a "diagonal type". In addition, the stapling operation positions p1 and p4 may be placed such that each of a diagonal stapling operation and a horizontal stapling operation is performed at a corresponding position.

Furthermore, as shown in FIG. 2, the stapler device according to the present disclosure may perform a stapling operation on a bundle of papers inserted from the outside at the stapling operation position p5 at which the stapler 11 is rotated outwardly from the processed and discharged bundle of papers or outwardly from the range of the reciprocating movement of the stapler 11. The stapling operation on the bundle of papers inserted from the outside may be performed according to a signal manually input from a user.

As shown in FIG. 3, when a paper insertion slit 171, through which the bundle of papers inserted from the outside is inserted, is provided in an edge of a case 17 configured to accommodating the stapler 11 according to the present disclosure, a stapling operation may be performed in a diagonal type as shown in FIG. 2 by inserting the bundle of papers through the paper insertion slit 171.

Figure 4:
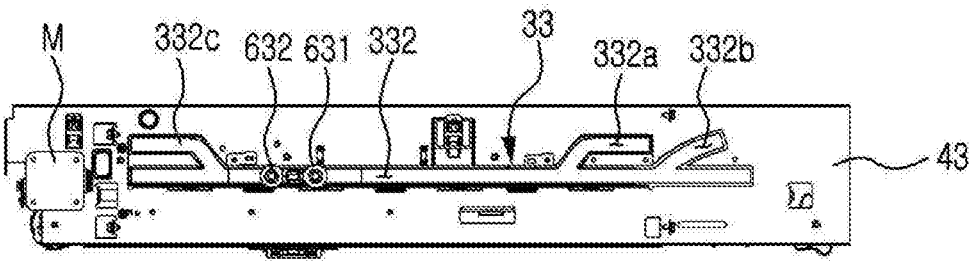
FIG. 4 is a bottom view of FIG. 1.
Figure 5:
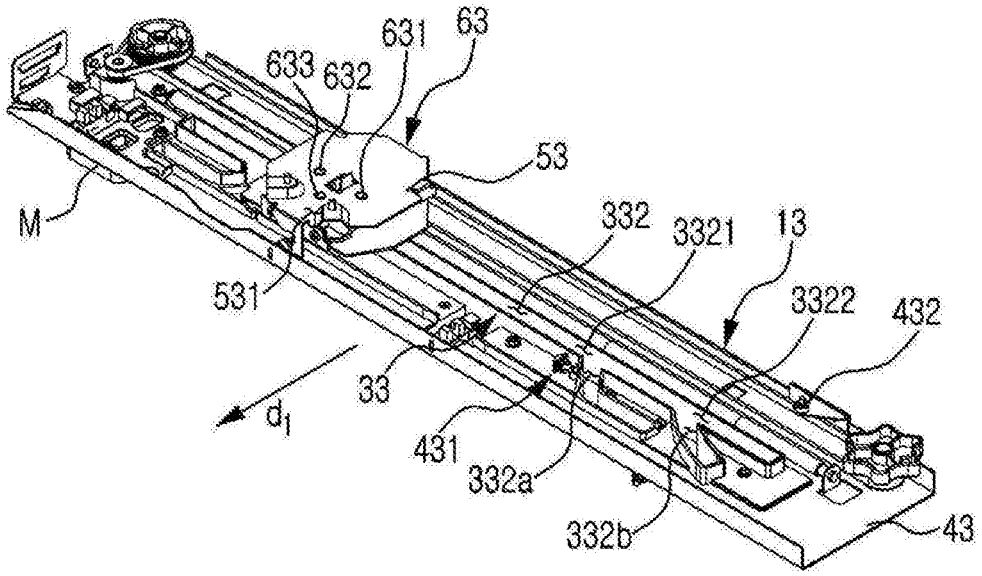
FIG. 5 is a view illustrating a state in which a stapler is removed from FIG. 1.
Figure 6:
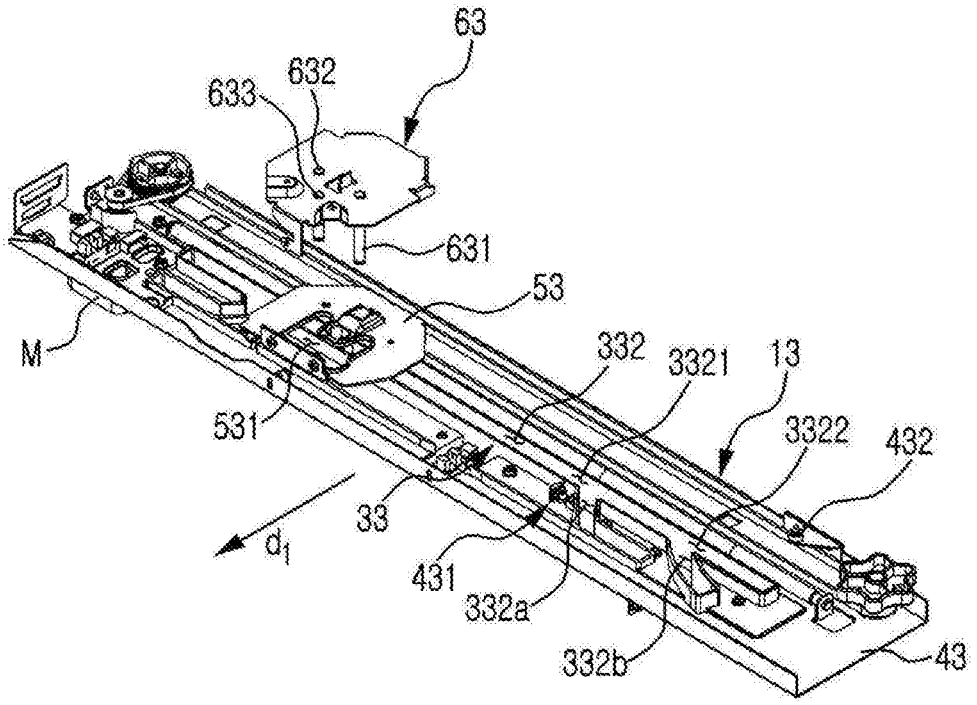
FIG. 6 is a view illustrating a state in which a rotational bracket is separated from FIG. 5.
Figure 7:
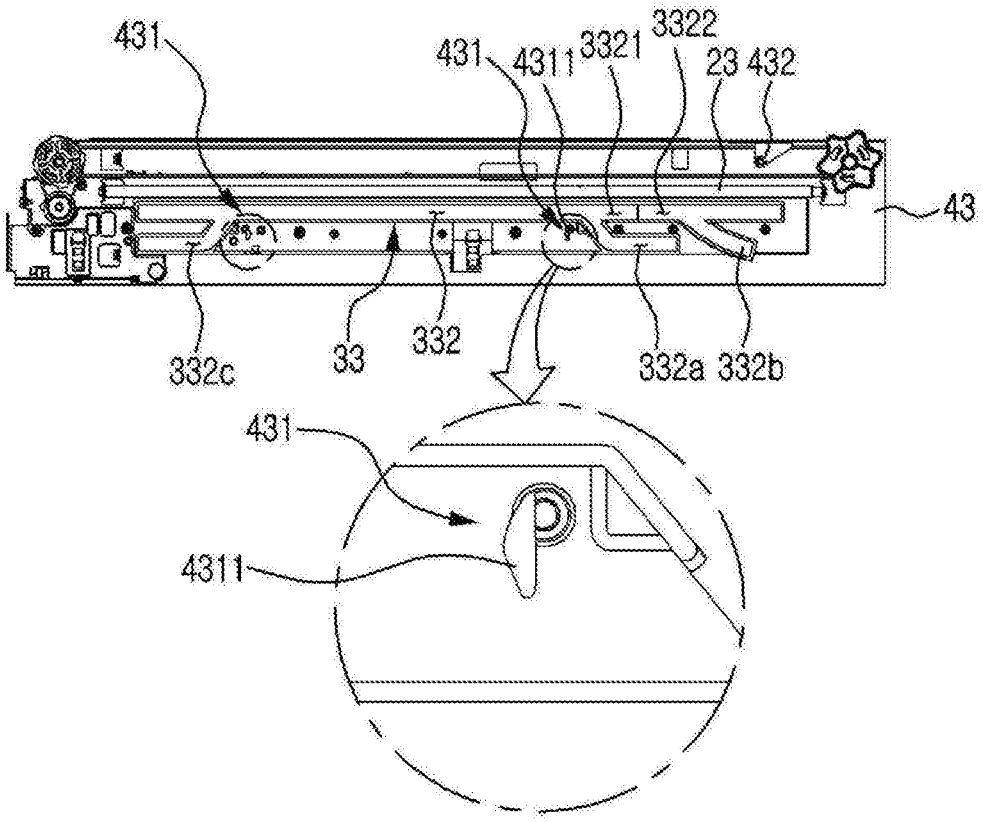
FIG. 7 is a plan view illustrating a state in which a mobile bracket and the rotational bracket are removed from FIG. 6.

FIG. 4 is a bottom view of FIG. 1. FIG. 5 is a view illustrating a state in which the stapler 11 is removed from FIG. 1. FIG. 6 is a view illustrating a state in which a rotational bracket 63 is separated from FIG. 5. FIG. 7 is a plan view illustrating a state in which a mobile bracket 53 and the rotational bracket 63 are removed from FIG. 6. Referring to FIG. 1 and FIGS. 4 to 7, the moving unit 13 for moving the stapler 11 includes a guide rod 23, a base frame 43 having a guide slot portion 33 installed therein, the mobile bracket 53 movably installed on the guide rod 23, and the rotational bracket 63 rotatably installed on the mobile bracket 53. The stapler 11 is installed on the rotational bracket 63 and is interlocked with the rotational bracket 63.

As in an example shown in drawings, the guide rod 23 may be installed in the base frame 43, but the present disclosure is not limited thereto. The guide rod 23 may be disposed in a direction in which the stapler 11 is linearly moved.

The mobile bracket 53 is slidably installed on the guide rod 23. A belt V driven by a motor M is connected to one end of the mobile bracket 53, such that the mobile bracket 53 is moved on the guide rod 23 when the belt V is moved.

Although not shown in drawings, in order for the mobile bracket 53 to be stably moved, the other end of the mobile bracket 53 may be slidably connected, for example, to the base frame 43.

As can best be seen in FIG. 5, the mobile bracket 53 may have a plate shape and may have a rotation guide hole 531 vertically passing therethrough.

The rotational bracket 63 is disposed on the mobile bracket 53 and includes a first lever 631, a second lever 632, and a first roller 633, provided on a lower surface thereof.

The first lever 631 and the second lever 632 are inserted to penetrate the rotation guide hole 531 of the above-described mobile bracket 53 and are movably coupled to a slot of the guide slot portion 33. That is, the first lever 631 and the second lever 632 may be coupled to the slot of the guide slot portion 33 and may be moved along the slot. Desirably, the first lever 631 and the second lever 632 may be configured to not easily deviate from the slot in a vertical direction in a state of being coupled to the slot of the guide slot portion 33, and this may be apparent to those having ordinary skill in the art. For example, as shown in FIG. 6, the first lever 631 and the second lever 632 may have a configuration in which a slot having the same shape as the slot of the guide slot portion 33 is formed in the base frame 43 and then a roller having a diameter greater than a width of the formed slot is disposed at a lower end of each of the first and second levers 631 and 632 and is hooked to the formed slot. Alternatively, although not shown, the first lever 631 and the second lever 632 may have a configuration in which rollers having different sizes are coupled to the first and second levers 631 and 632 and a hooking portion is formed at an upper end of a sidewall 331 having a certain height formed in the guide slot portion 33 as shown in FIG. 1.

As described above, since the first and second levers 631 and 632 formed on the lower surface of the rotational bracket 63 are movably coupled to the slot of the guide slot portion 33, the rotational bracket 63 is moved together with the mobile bracket 53 when the mobile bracket 53 slides on the guide rod 23.

The guide slot portion 33 installed in the base frame 43 may have any shape as long as the first lever 631 and the second lever 632 are movably coupled to the slot thereof, and is not limited to an example shown.

In an example shown, the guide slot portion 33 may be formed as the sidewall 331 having the certain height such that a slot is formed. The slot to be formed has a plurality of branch structures. That is, the branch structures of the slot may include a main branch 332 and a plurality of branches having a first branch 332*a*, a second branch 332*b*, and the like, connected to the main branch 332. In an example shown, when a portion at which the first branch 332*a* and the second branch 332*b* are disposed is called one end portion of the slot, a mirror shape of the first branch 332*a*, i.e., a branch 332*c* is disposed at the other end portion of the slot. As described above, the first branch 332*a* and the mirror shape thereof, i.e., the branch 332*c* are a branch for rotating the stapler 11 inwardly in order to diagonally staple the bundle of papers discharged from the image forming apparatus or the post-processing apparatus. On the contrary, the second branch 332*b* disposed at an end of the one end portion of the slot is a branch for rotating the stapler 11 outwardly in order to diagonally staple the bundle of papers inserted from the outside.

All of the first branch 332*a*, the second branch 332*b*, and the mirror shape thereof, i.e., the branch 332*c* are branches branched to protrude from the main branch 332 in a direction in which papers are discharged. Actually, when the first lever 631 at a front end is sequentially moved to all of the branches from a movement direction, the rotational bracket 63 and the stapler 11 mounted thereon are rotated toward the range of the reciprocating movement of the stapler 11 or toward a paper discharge region. On the contrary, when the second lever 632 is moved to all of the branches, the rotational bracket 63 and the stapler 11 mounted thereon are rotated outwardly from the range of the reciprocating movement of the stapler 11 or outwardly from the paper discharge region. In this case, the bundle of papers inserted from the outside are in a state of being stapled.

In an exemplary embodiment shown, the first branch 332*a* and the mirror shape thereof, i.e., the branch 332*c* are used to rotate the stapler 11 inwardly, and the second branch 332*b* is used to rotate the stapler 11 outwardly.

In order to rotate the rotational bracket 63 and the stapler 11 mounted thereon by moving the first lever 631 or the second lever 632 formed on the lower surface of the rotational bracket 63 to the first branch 332*a* or the second branch 332*b*, a cam portion 431 and a second roller 432 are provided in the base frame 43. In addition, the first roller 633 is provided on the lower surface of the rotational bracket 63, and a contact portion 634 is provided on a side surface of the rotational bracket 63.

In an example shown, the cam portion 431 and the first roller 633 are elements for moving the first lever 631 to the first branch 332*a*, and the second roller 432 and the contact portion 634 are elements for moving the second lever 632 to the second branch 332*b*.

As can best be seen in an enlarged view of FIG. 7, the cam portion 431 includes a cam shaft, a cam element 4311 rotatably installed on the cam shaft, and an elastic operating portion including a spring operated to allow the cam element 4311 to rise in a direction intersecting with the main branch 332. In addition, the cam element 4311 has a surface in contact with the first roller 633, i.e., a convex surface, and a plane surface opposite to the convex surface.

Figure 8:
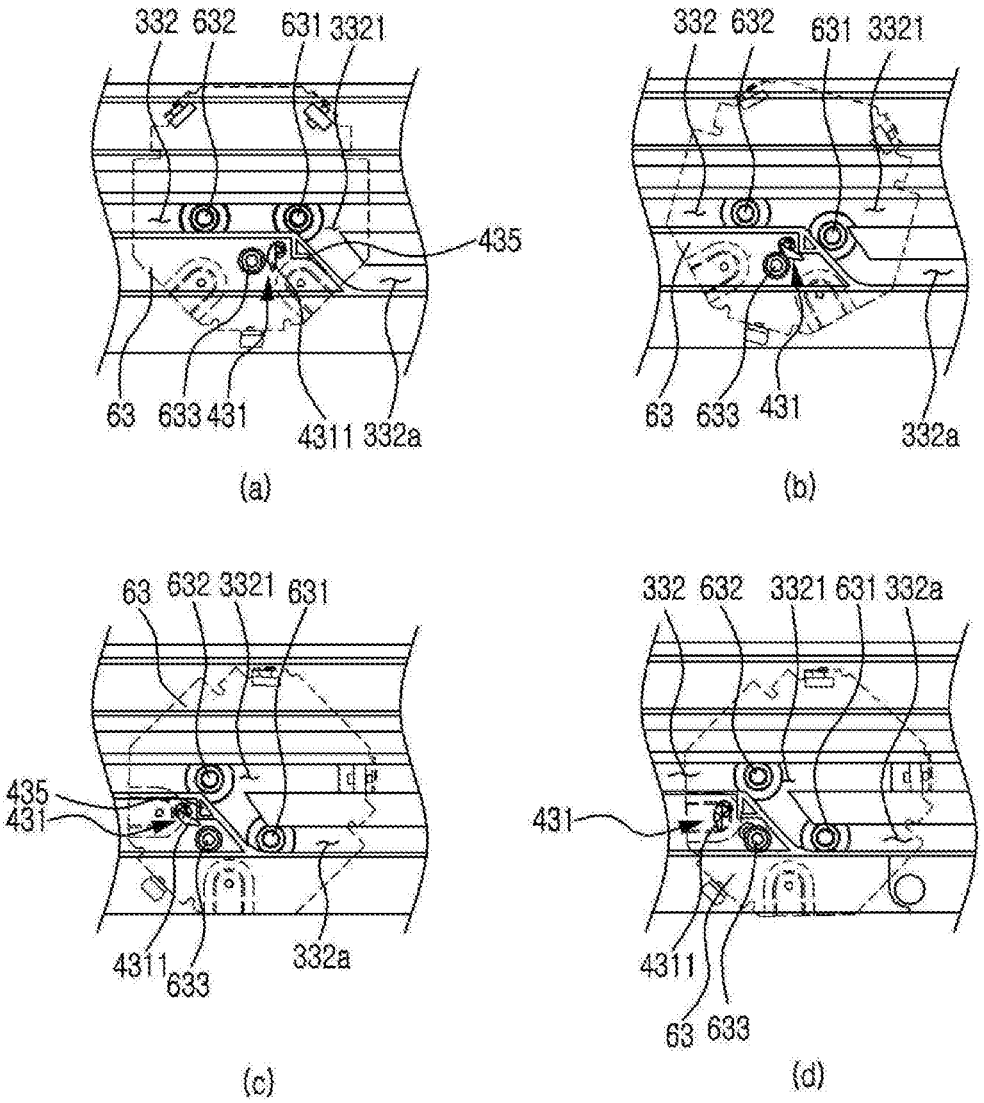
FIGS. 8 to 10 are views illustrating a rotational operation of the stapler device according to the present disclosure.
Figure 9:
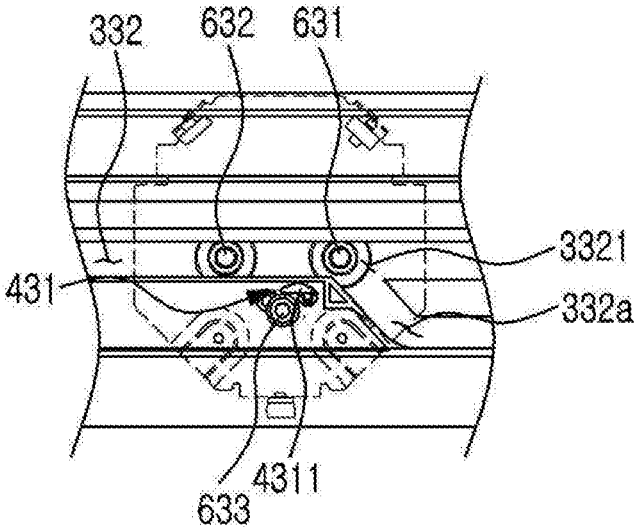
Figure 10:
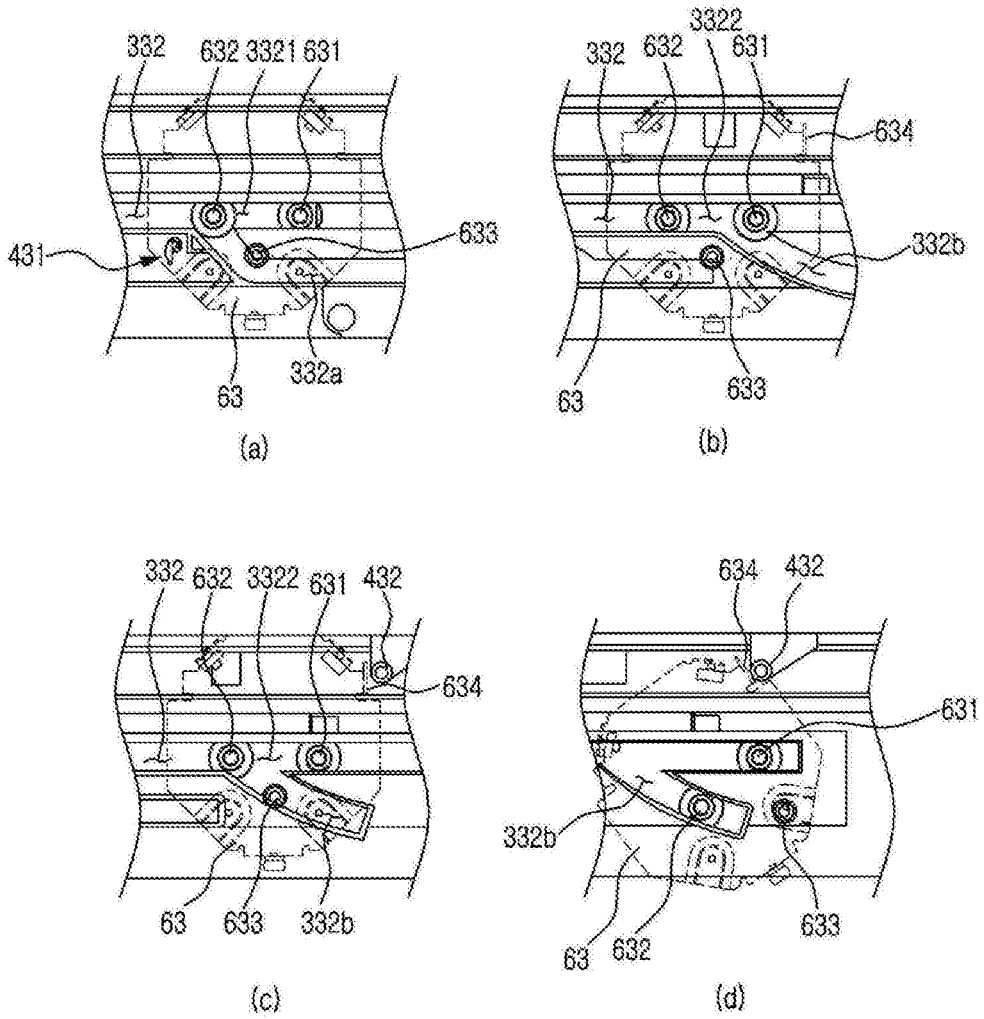

Hereinafter, an operation in which the first lever 631 or the second lever 632 is moved to the first branch 332*a* or the second branch 332*b* to rotate the rotational bracket 63 will be described with reference to FIGS. 8 to 10. FIGS. 8 to 10 illustrate a state in which the mobile bracket 53 is removed for convenience of understanding.

In an example shown, the first lever 631 is moved to the first branch 332*a* to rotate the rotational bracket 63 toward the discharged bundle of paper, i.e., toward the range of the reciprocating movement of the stapler 11, and then, the first lever 631 deviates from the first branch 332*a*. After that, the second lever 632 is continuously moved to the second branch 332*b* to rotate the rotational bracket 63 outwardly from the discharged bundle of papers. The former operation is performed to diagonally staple the bundle of papers processed and discharged from the image forming apparatus or the post-processing apparatus, and the latter operation is performed to diagonally staple the bundle of papers inserted from the outside.

In an example shown, the mobile bracket 53 is moved from left to right by the motor M and the belt V.

First, an operation in which the first lever 631 is moved to the first branch 332*a* will be described with reference to (a) to (d) of FIG. 8.

While the rotational bracket 63 is precedently moved (from left to right), when the first lever 631 reaches a first branch point 3321 at which the first branch 332*a* is branched, the cam element 4311 of the cam portion 431 comes into contact with the first roller 633 ((a) of FIG. 8) to move the first roller 633 away from the main branch 332 of the slot ((b) of FIG. 8). As described above, since the first roller 633 comes into contact with the convex surface of the cam element 4311 and is continuously moved in a movement direction, the first lever 631 rotates the rotational bracket 63 away from the main branch 332 while spontaneously moving away from the main branch 332. As in an example shown, a rotation angle may be adjusted by forming a stepped portion 435 supporting the cam element 4311 on the sidewall 331 of the guide slot portion 33.

As in (c) and (d) of FIG. 8, the rotational bracket 63 is placed at a position (the stapling operation position p4 of FIG. 2) for a diagonal stapling operation. As described above, when the first lever 631 located at the front end in a movement direction is moved to the first branch 332*a*, the stapler 11 is rotated toward the discharged bundle of papers. In this case, since the first lever 631 is in a state of being sufficiently moved to the first branch 332*a* to pass through the cam element 4311, the cam element 4311 rises again by the elastic operating portion including a spring.

FIG. 9 is a diagram illustrating an operation in which the first lever 631 deviates from the first branch 332*a*.

In order for the first lever 631 to deviate from the first branch 332*a*, the mobile bracket 53 needs to be precedently moved in a reverse direction. In order to staple the bundle of papers inserted from the outside, after the first lever 631 is moved to the first branch 332*a*, the first lever 631 should deviate from the first branch 332*a*.

In order for the first lever 631 placed in the first branch 332*a* to deviate from the first branch 332*a*, the mobile bracket 53 is moved in the reverse direction. Then, the first roller 633 inversely pushes the upright cam element 4311 to lay the cam element 4311 in an opposite direction thereof. When the cam element 4311 is laid, the first lever 631 deviates from the first branch 332*a* and is located at the first branch point 3321. Here, the first roller 633 continuously inversely pushes the cam element 4311 to maintain a state in which the cam element 4311 is laid.

(a) to (d) of FIG. 10 illustrates an operation in which the second lever 632 is moved to the second branch 332*b* to rotate the rotational bracket 63 outwardly.

After the first lever 631 deviates from the first branch 332*a*, when the mobile bracket 53 is continuously moved back to the one end portion, the first lever 631 passes through the first branch point 3321 and is continuously moved along the main branch 332 ((a) of FIG. 10). The first roller 633 may have a height (thickness) so as to be free from interference of the sidewall 331 of the guide slot portion 33, or the sidewall 331 of the guide slot portion 33 on a movement path of the first roller 633 may be partially removed, such that the first roller 633 may be moved without interference.

When the first lever 631 and the second lever 632 are continuously moved along the main branch 332 of the slot ((b) of FIG. 10) and are located at a second branch point 3322 ((c) of FIG. 10), while the second roller 432 provided in the base frame 43 comes into contact with the contact portion 634 provided on the side surface of the rotational bracket 63, the rotational bracket 63 is rotated. Then, the second lever 632 is moved to the second branch 332*b*, and the first lever 631 and the second lever 632 are moved to the stapling operation position p5 along the slot by a precedence movement of the mobile bracket 53 ((d) of FIG. 10).

When the first lever 631 and the second lever 632 reach the stapling operation position p5 shown in FIG. 2, as shown in FIG. 3, the stapler 11 is located at the edge of the case 17 and staples the bundle of papers inserted from the outside through the paper insertion slit 171 provided at a corresponding position of the case 17.

As described above, the stapler device according to the present disclosure can perform a diagonal stapling operation on a bundle of papers manually inserted from the outside thereof. In addition, desirably, the stapler device can perform horizontal and diagonal stapling operations on a bundle of papers discharged after a post-processing operation such as an aligning operation or a folding operation and can also perform a diagonal stapling operation on a bundle of papers inserted from the outside by a user.

According to the present disclosure, provided is a stapler device which is applied to an image forming apparatus or a post-processing apparatus and is capable of performing an automatic stapling operation on a bundle of papers processed and discharged from the image forming apparatus or the post-processing apparatus as well as a stapling operation on a bundle of papers inserted from the outside. In particular, the stapler device can perform a diagonal stapling operation on the bundle of papers inserted from the outside by a user.

Although several exemplary embodiments of the present disclosure have been described for illustrative purposes, those skilled in the art will appreciate that various modifications, additions and substitutions are possible, without departing from the scope and spirit of the present disclosure as disclosed in the accompanying claims.

What is claimed is:

1. A stapler device installed to staple a bundle of papers processed and discharged from an image forming apparatus or a post-processing apparatus, the stapler device comprising:

a stapler; and a moving unit installed to allow the stapler to reciprocate in a direction intersecting with a discharge direction of the bundle of paper, wherein the moving unit rotates the stapler outwardly such that a bundle of papers inserted from the outside in addition to the discharged bundle of papers is stapled in at least one end position of a range of the reciprocating movement;

wherein the moving unit is installed to allow the stapler to perform the reciprocating movement which is a linear movement in the direction intersecting with the discharge direction of the bundle of paper, and rotate the stapler at a set position on the linear movement, and wherein the stapler is configured to staple the discharged bundle of papers such that a staple is disposed in directions parallel and diagonal to an upper side of the discharged bundle of paper, and to staple the bundle of papers inserted from the outside in a direction diagonal to an upper side of the bundle of papers inserted from the outside, wherein the moving unit comprises:

a guide rod disposed in a direction of the reciprocating movement;

a base frame provided with a guide slot portion having a slot that has a plurality of branch structures including a main branch disposed in a direction parallel to the guide rod and branches branched from the main branch;

a mobile bracket installed to move on the guide rod when an external force is applied thereto, and having a rotation guide hole vertically passing therethrough; and a rotational bracket disposed on the mobile bracket in a state of being mounted with the stapler, comprising a first lever and a second lever inserted into the slot of the guide slot portion through the rotation guide hole and disposed to be movable along the slot, and moved together with the mobile bracket when the mobile bracket is linearly moved, wherein, when at least one of the first lever and the second lever is moved to the branch of the slot, the rotational bracket is rotated; and wherein, when the second lever is moved to the branch of the slot, the rotational bracket is rotated outwardly from a discharge region of the bundle of papers.

2. The stapler device of claim 1, wherein, when the first lever is moved to the branch of the slot, the rotational bracket is rotated toward the range of the reciprocating movement.

3. The stapler device of claim 2, wherein the slot of the guide slot portion has a first branch and a second branch sequentially disposed along the main branch on at least one end portion thereof, the first lever is moved to the first branch, and the second lever is moved to the second branch disposed at an end of the one end portion of the slot.

4. The stapler device of claim 3, wherein a first roller is provided on a lower surface of the rotational bracket, and a cam portion is provided in the base frame, wherein, while the rotational bracket is precedently moved, from when the first lever reaches a first branch point at which the first branch is branched, the cam portion comes into contact with the first roller to move the first roller away from the main branch of the slot, such that the first lever is moved to the first branch and the stapler is rotated toward the range of the reciprocating movement.

5. The stapler device of claim 4, wherein the cam portion comprises:

a cam shaft;

a cam element rotatably installed on the cam shaft; and an elastic operating portion including a spring operated to allow the cam element to rise in a direction intersecting with the main branch of the slot, wherein the cam portion has a convex surface which is a surface in contact with the first roller.

6. The stapler device of claim 4, wherein a second roller is provided in the base frame, wherein, in a state in which the first lever passes through a second branch point and is continuously moved along the main branch, from when the second lever reaches the second branch point at which the second branch is branched, the second roller comes into contact with one side of the rotational bracket to rotate the rotational bracket, such that the second lever is moved to the second branch and the stapler is rotated outwardly from the discharge region of the bundle of papers.

7. The stapler device of claim 6, wherein, after the mobile bracket is precedently moved in a reverse direction, that is, toward the other end portion of the slot and the first lever deviates from the first branch, in a state in which the mobile bracket is precedently moved to the one end portion of the slot and the first lever passes through the first branch point and the second branch point and is moved along the main branch, the second lever is moved to the second branch.

8. The stapler device of claim 4, further comprising a case covering the stapler and having a paper insertion slit opened in an edge thereof, through which a bundle of papers is inserted from the outside, wherein, when the stapler is rotated outwardly from the discharge region of the bundle of paper, the stapler is disposed to staple the bundle of papers inserted through the paper insertion slit.

* * * * *